US005867452A

United States Patent [19]

Braun et al.

[11] Patent Number: 5,867,452

[45] Date of Patent: Feb. 2, 1999

[54] WATCH WITH INVISIBLE SPEAKER

[75] Inventors: Rafael Braun, Flushing, N.Y.; Hung Fat Lee, Shatin, Hong Kong

[73] Assignee: E. Gluck Corp., Long Island City, N.Y.

[21] Appl. No.: 953,182

[22] Filed: Oct. 17, 1997

[51] Int. Cl.[6] ..... G04C 21/16; G04B 37/00

[52] U.S. Cl. ..... 368/72; 368/88; 368/250

[58] Field of Search ..... 368/10, 63, 72–75, 368/88, 243, 250, 255

[56] References Cited

U.S. PATENT DOCUMENTS

| | | | |
|---|---|---|---|
| 3,577,876 | 5/1971 | Spadini . | |
| 3,875,738 | 4/1975 | Khikawa et al. . | |
| 4,250,573 | 2/1981 | Saito | 368/73 |
| 4,258,432 | 3/1981 | Zafferri et al. | 368/250 |
| 4,271,498 | 6/1981 | Zafferri et al. | 368/250 |
| 4,330,878 | 5/1982 | Nakamura | 368/250 |
| 4,374,624 | 2/1983 | Murata | 368/250 |
| 4,391,532 | 7/1983 | Hara | 368/250 |
| 4,918,674 | 4/1990 | Shimozono et al. | 368/255 |
| 5,050,138 | 9/1991 | Yamada et al. | 368/10 |
| 5,440,526 | 8/1995 | Pierce et al. | 368/63 |

FOREIGN PATENT DOCUMENTS

| | | | |
|---|---|---|---|
| 2836985 | 3/1979 | Germany | 368/72 |
| 61-281844 | 3/1982 | Japan . | |
| 61-281845 | 3/1982 | Japan . | |
| 64-452 | 3/1982 | Japan . | |
| 57-74679 | 5/1982 | Japan . | |
| 57-180215 | 11/1982 | Japan . | |
| 58-191532 | 1/1983 | Japan . | |
| 3-245085 | 4/1990 | Japan . | |

*Primary Examiner*—Vit Miska

*Attorney, Agent, or Firm*—Gottlieb, Rackman & Reisman, P.C.

[57] ABSTRACT

A watch case for a digital or analog watch assembly. The watch case includes a body, a time display element, an electronic speaker unit for generating musical or other acoustical sounds, and an aperture formed in the body which communicates with the speaker. Significantly, the aperture is sized so that the quality sound (e.g., music and voices) emitted therethrough from said speaker unit is clearer and more understandable than has been available heretofore.

11 Claims, 4 Drawing Sheets

WATCH WITH INVISIBLE SPEAKER

BACKGROUND OF THE INVENTION

This invention relates to a new type of watch construction, and more particularly to a watch design in which the case thereof includes within its usual dimensions a sound chamber and an electronic speaker for generating musical sounds.

Prior art wristwatches broadly describe use of "sound" in a wristwatch. However, the acoustical quality of such sound-producing devices is severely limited by the type of sound-generating devices and the size of the enclosure. For example, many of the so-called "speaker" watches to date are just achieving synthesized (simulated) speech. Typical among these are U.S. Pat. Nos. 5,440,526 and 5,197,044 which describe an integrated circuit with clock functions and the like, which not only actuates an animation feature, whereby the mouth of the character moves, but also synthesizes speech and drives the speaker. In this design, a very large and quite cumbersome case with the embodiment of the character mounted thereon is utilized, as compactness and generating quality music was never the goal, and certainly was not achieved in the prior art arrangements.

The prior art also includes analog watch designs also using piezoelectric buzzers to generate sound through a vibrating or perforated case back, thus marring the attractive and fashionable cases such analog watches strive to attain, as well as producing sounds not suitable for musical watches.

For digital watches, speakers have been used in the past to announce time when a button was pressed. However, since the level of enunciation and intonation was not very high in the first place, the positioning of the speaker in the watch case was not found to be critical, and little attention was paid to this feature.

Accordingly, it is desirable to provide a wristwatch assembly, whether analog or digital, which includes a watch case having incorporated therein an electronic speaker unit for generating sophisticated acoustical and musical sounds.

SUMMARY OF INVENTION

Generally speaking, in accordance with the invention, a watch case for a digital and especially for analog watch assembly is provided. The watch case includes a body, a time display element, and a sound chamber with an electronic speaker unit for generating musical or other acoustical sounds, and an aperture or channel formed discretely in the body which communicates with the sound chamber. Significantly, the aperture is sized so that the sound emitted therethrough from the speaker unit is sufficiently clear and understandable for high quality acoustical reproduction.

The watch case further includes a pushbutton or other activating mechanism for selectively operating the speaker unit and an internal battery for supplying power to the speaker.

Accordingly, it is an object of the invention to provide a watch with an internal speaker and electronic driving circuit in the watch case in a particular location thereof in order to achieve improved sound emissions.

Still another object of the invention is to provide a watch in which a regular speaker of reduced size is incorporated inside a watch case in lieu of a piezoelectric buzzer.

Yet a further object of the invention is to provide a watch in which the watch case includes a sound chamber and a sound-emitting aperture that is specially placed in order to enhance clarity of the sound emitted from a sound chamber and a speaker incorporated therein and avoid any aesthetically displeasing look to the watch case.

Still other objects and advantages of the invention will in part be apparent from the following description.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

Figure 1:
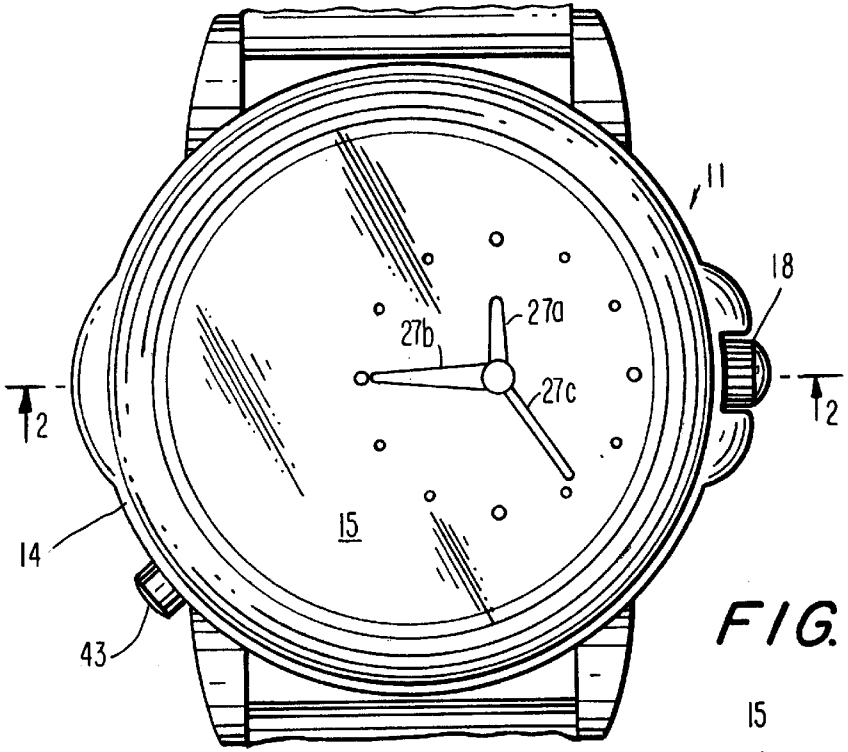
FIG. 1 is a top plan view of the watch case of the invention.
Figure 2:
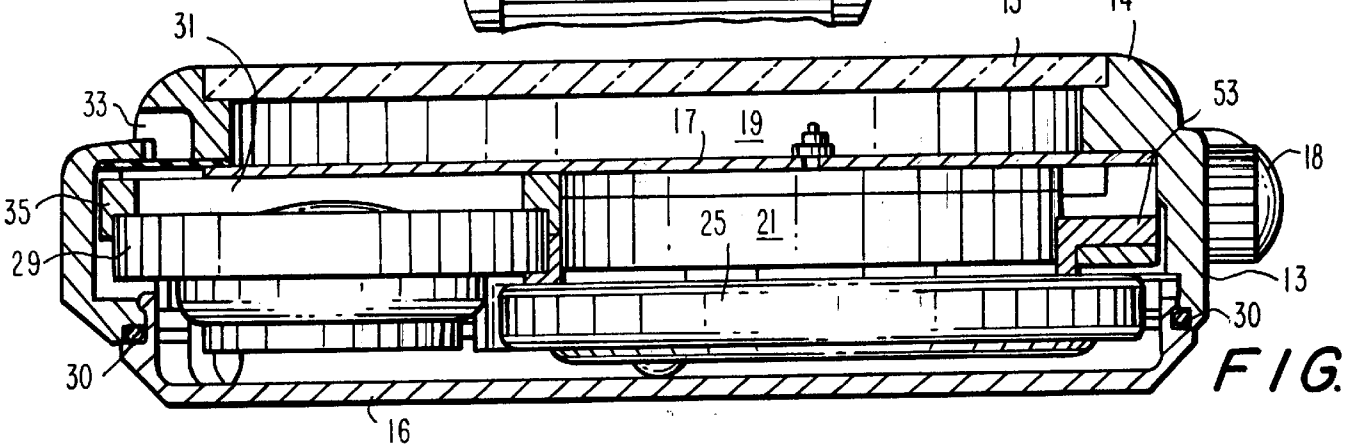
FIG. 2 is a cross-sectional view of the watch case of the invention.
Figure 3:
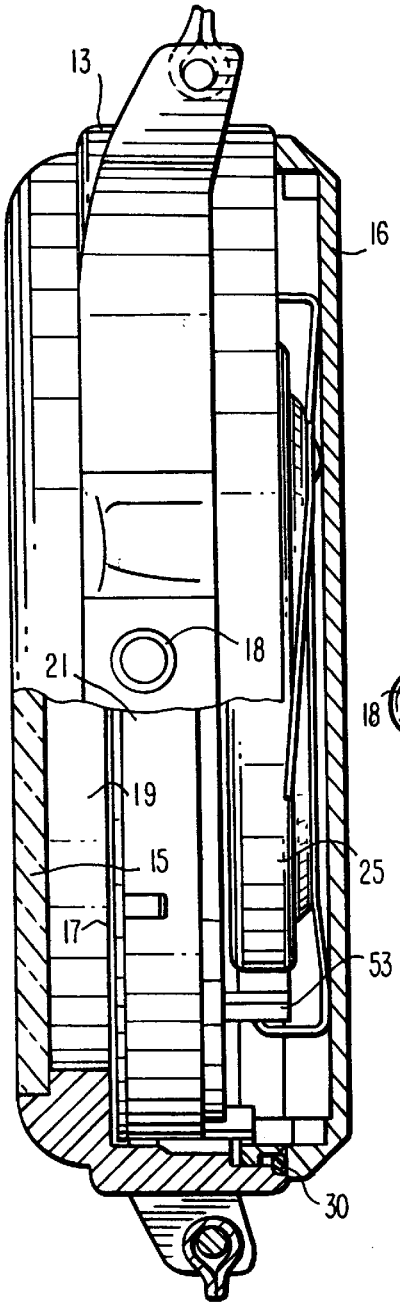
FIG. 3 is a side elevational view, in partial cross-section, of the watch case of the invention.
Figure 4:
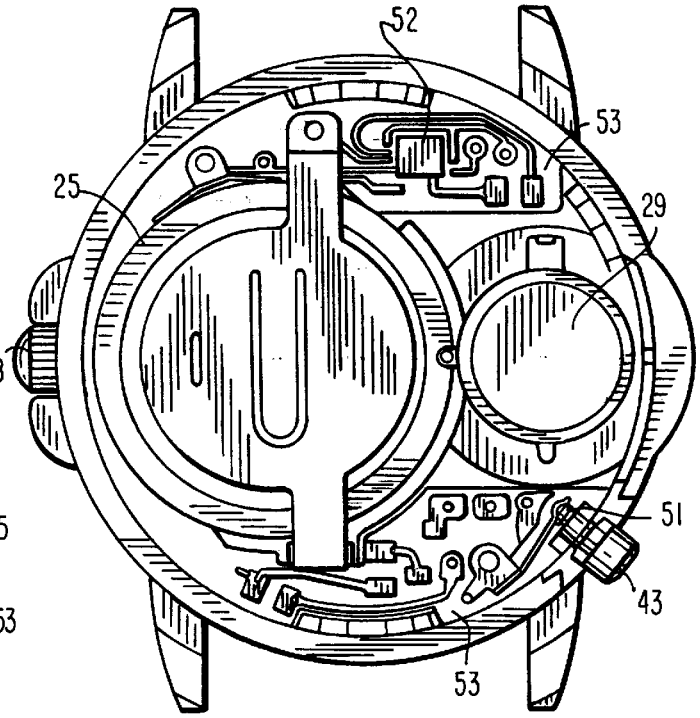
FIG. 4 is a bottom plan view, partially cut away, of the watch case of the invention.
Figure 5:
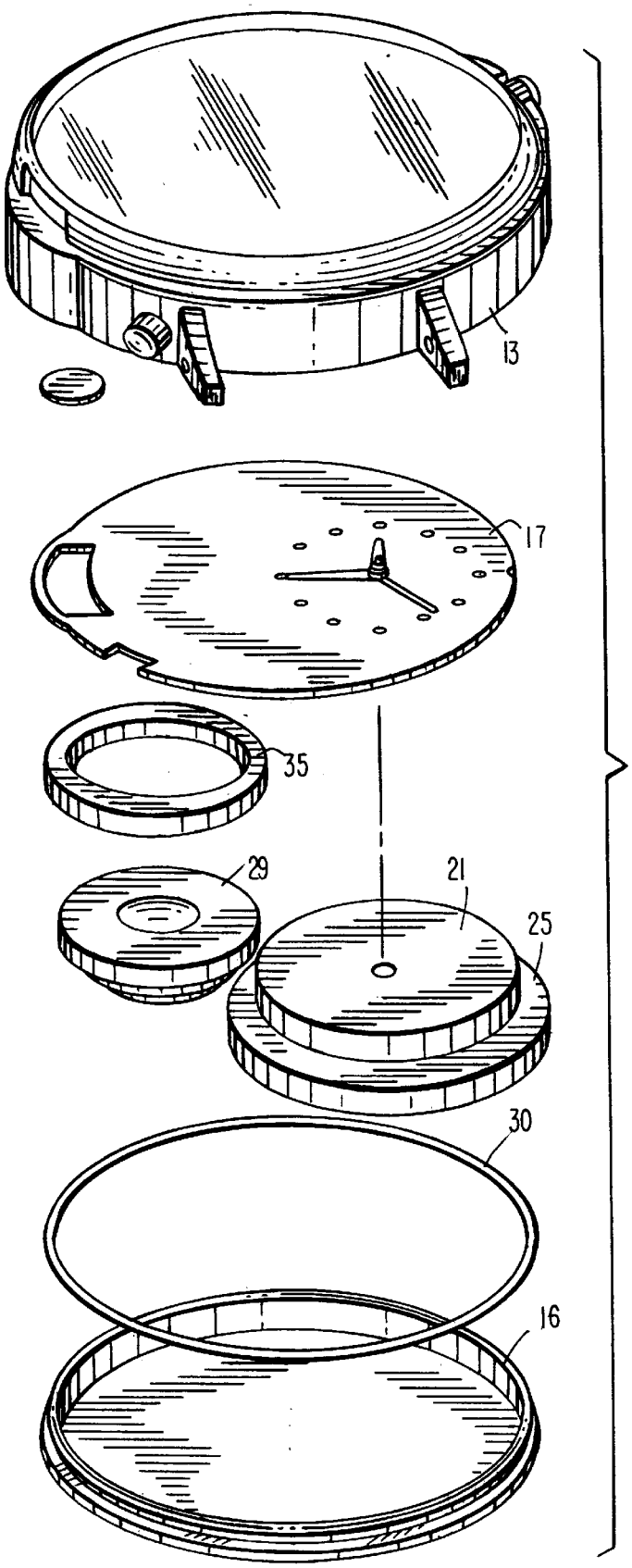
FIG. 5 is an exploded perspective view of the component parts of the inventive watch case.

Referring now to FIGS. 1–5, a watch case for an analog watch assembly generally indicated at 11 and made in accordance with the invention is now described. Watch case 11 comprises body 13, bezel 14, crystal 15 and a back 16 screwed or otherwise removably attached to body 13 and sealed thereto by means of an O-ring 30. As shown in FIG. 2, case 11 defines a first chamber that includes a dial 17 and a crown 18, connected to a stem (not shown) to adjust the hands of the watch and any other parameters displayed on a particular model. Dial 17 is separated from crystal 15 by a space 19. Along the outer surface of dial 17, there is provided conventional hour, minute and second hands 27*a*, 27*b* and 27*c* respectively. Beneath dial 17, case 11 houses a movement 21, with its own internal operating battery, as is well known in the art, for directing rotational movement of hands 27*a–c*, so that the watch reflects the correct time. As shown in FIG. 2, movement 21 is proximate to a conventional battery 25 used for continuously producing an electric current to be supplied to the circuit of a speaker 29 and its control circuit 100, as discussed more fully below.

Referring still to FIGS. 1–5 collectively, watch case 11 also defines a second chamber containing miniaturized speaker 29 for emitting a musical or other acoustical sound when energized. Speaker 29 is surrounded at its upper portion by gasket 35 to hold speaker 29 in position, as well as to insulate the inside parts of case 11, located beyond speaker 29, from moisture and dust. Speaker 29 is optimally sized so as to be placed in a side-by-side relationship with respect to movement 21, as best depicted in FIG. 2. Watch case 11 further includes a sound chamber 31 disposed directly above speaker 29 and a sound output channel 33 leading from chamber 31 to the outside. Sound chamber 31 is sized so as to allow the acoustical sounds from speaker 29 to reverberate and then emerge through channel 33—in other words, chamber 31 is sized such that sounds produced by speaker 29 are able to freely vibrate in order to obtain a sufficiently high sound pressure. Chamber 31 is insulated by gasket 35 surrounding speaker 29, which prevents sound waves emitted from the front of speaker 29 to be interfered with by those emitted from the back of speaker 29. As a result, speaker 29 has an enhanced quality and volume of sound.

Channel 33 leading from chamber 31 is placed away from crystal 15 below a top portion of bezel 14 extending in a radial direction within said case and terminating or exiting laterally of and adjacent to the dial 17 as shown in FIG. 2 so that it is hidden from view. As a result, channel 33 will not interfere with the cosmetic appearance of watch case 11, and the sound which emerges therethrough will have undisturbed clarity. (If channel 33 were placed under crystal 15 or along back 16, sound clarity would be less than desirable.) In particular, when speaker 29 vibrates, speaker 29 produces a substantial sound pressure in chamber 31, which is released solely through channel 33 to the outside. Since channel 33 communicates directly with the outside, and is not covered over by crystal 15, or the wrist of one's hand (if located on the back of case 11), a clear, uninterrupted and superior sound is produced when speaker 29 is activated.

Figure 6:
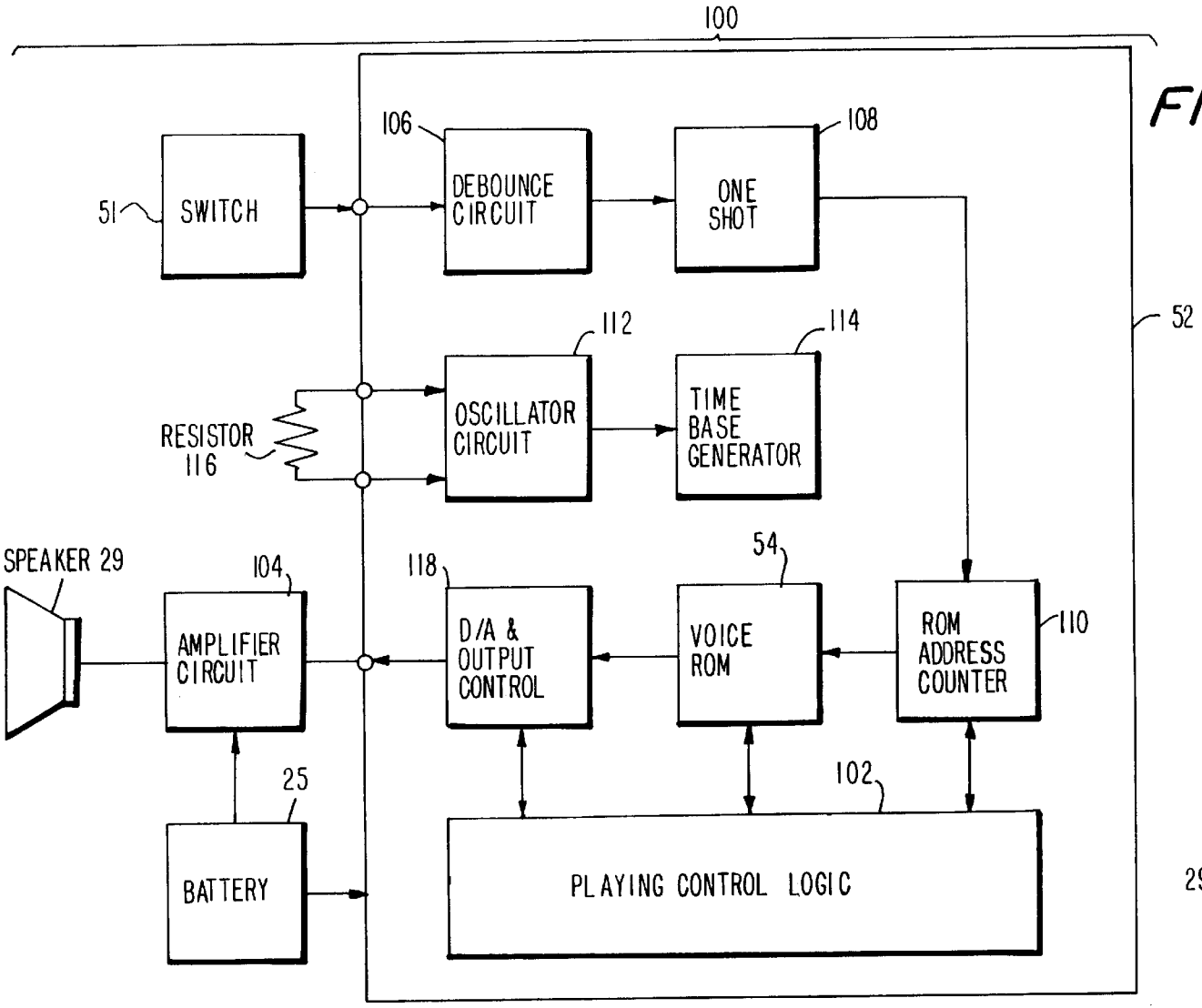
FIG. 6 is a block diagram for the electronic components of the watch of FIGS. 1–5.

In order to activate speaker 29, case 11 is provided with a sound-activating button 43 which, when pressed, engages a switch contact 51 to activate the speaker control circuit described below and cause speaker 29 to produce an acoustical sound. Preferably, the sound is music and/or the distinct known voices of celebrities, separately or combined—a "Looney Tunes selection" with Mel Blanc's voice, for example—digitally stored in a ROM on a memory and control chip 52 (as shown in FIG. 6) mounted on a printed circuit board ("P.C.B.") 53. (P.C.B. 53 has been omitted from FIG. 5 for the sake of clarity.) Switch contact 51 is also connected to the same P.C.B. 53. The original source of the music can vary—i.e., musical notes or sounds, or some type of audio tape recording. In either case, the sound is converted to digital data and stored on the ROM. Therefore, in accordance with the invention, the sound output can be changed merely by changing the P.C.B. 53 (or the memory and control chip 52). This sound is transmitted into sound chamber 31 and thence out through output channel 33, as described above.

Optionally, the portion of dial 17 overlying sound chamber 31 may have inscribed thereon a character or picture which in some manner relates to the musical sound produced when speaker 29 is activated.

Although in the embodiment described herein, movement 21 is positioned in a side-by-side relationship with respect to speaker 29 and thus hands 27*a–c* are disposed off-center, it is possible to have a watch case design in which the arms are centered in a conventional fashion. This would obviously require the movement to be disposed centrally within the case, thereby requiring a differently sized speaker element or a larger watch case.

Referring now to FIG. 6, the speaker 29 is controlled by the speaker control circuit 100. Circuit 100 includes memory and control chip 52, switch 51, amplifier 104 and resistor 116. With the exception of switch 51, these elements are mounted on P.C.B. 53. Memory and control chip 52 includes ROM 54, as well as several other elements described in more detail below and illustrated in FIG. 6.

When switch 51 is closed, its output is fed first to a debounce circuit 106. The output of circuit 106 is fed to a one shot multivibrator 108. The multivibrator 108 sends a pulse to a ROM address counter 110.

Circuit 100 further includes an oscillator 112 and a time base generator 114. The frequency of the oscillator may be set by the external trimming resistor 116.

Finally, the circuit 100 includes a D/A (digital-to-analog converter) and output control circuit 118.

Power to all these components is provided by battery 25.

The control circuit 100 can also be implemented by using discrete components mounted on board 53, or can be provided as a single custom designed IC 52. Alternatively, the control circuit 100 can be implemented as two IC's: a ROM 54 and a separate chip containing all the other components of the circuit 100.

The circuit 100 operates as follows. While the system is quiescent, the output of the output control circuit is low (i.e., zero volts) thus turning the amplify circuit 104 off. As a result, this circuit 104 and the speaker 29 drain no power from the battery 25. When switch 51 is activated, a pulse is sent to counter 110. In response the counter is initialized to a first address. This first address is fed to ROM 54 and used to retrieve a first digital word of the data stored in ROM 54. This word is fed to output control in response to commands from control logic 102. The digital word is converted into an analog signal and fed to amplify circuit 104. The circuit amplifies the analog signal and sends it to the speaker 29. The counter 110 is then incremented to the next address and the process is repeated for a second digital word. This process continues until all the data is retrieved and played by speaker 29 as a corresponding musical (or other type of audio) selection. Alternatively, if the switch 51 is closed again, the musical selection can be stopped, and the counter 110 could be reset. The generator 114 generates timing signals which can be used as clock signals by the control circuit 100. Preferably, a separate circuit within movement 21 is used to derive the signals driving hands 27*a*, 27*b*, 27*c*. Alternatively, generator 114 may also be used to derive these latter drive signals for both circuit 100 and a motor (not shown) activating hands 27*a*, 27*b*, 27*c*, in which case movement 21 is not needed.

Figure 7:
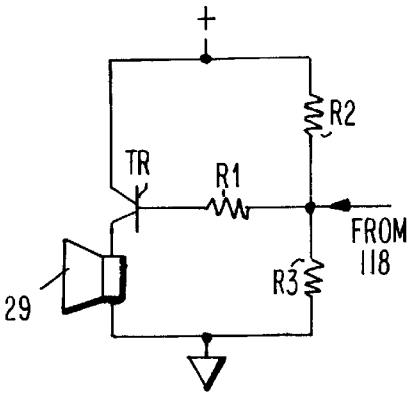
FIG. 7 shows a simple diagram for the amplifying circuit of FIG. 6.

A simple circuit for implementing amplify circuit 104 is shown in FIG. 7. In this Figure, resistors R2 and R3 are used to bias transistor TR. When the signal from output control circuit 118 is low. the transistor TR is off. When the signal goes high, transistor TR turns active and amplifies this signal. This circuit is advantageous over other complicated circuits, such as push-pull or transformer-based circuits because it has a very low power drain.

The speaker 29 may be a standard 8 or 16 ohm speaker available as an off the shelf item. However, preferably, it is a modified speaker having an impedance of about 64 ohms to increase its efficiency to produce a high volume sound with a standard 3 volt battery. Moreover, a high impedance speaker is also advantageous because it has a lower current consumption and hence presents a lower load on the battery.

It will thus be seen that the objects set forth above, among those made apparent from the preceding description, are efficiently attained and, since certain changes may be made in carrying out the above description, without departing from the spirit of the invention, it is intended that all matter contained in the description is to be merely illustrative.

Moreover, the following claims define the scope of the invention described herein.

We claim:

1. A wristwatch comprising:

a case;

a bezel;

a crystal secured to said case by said bezel;

an analog movement disposed in said case;

a dial with at least two hands coupled to said analog movement and disposed under said crystal;

a speaker disposed in said case and arranged and constructed to produce voice-quality sounds;

a speaker control circuit for driving said speaker to selectively produce said sounds; and a sound output channel leading to the outside to allow said sounds to emerge, said sound output channel extending radially within said case and exiting adjacent to said dial so that said sound output channel is hidden from view.

2. The wristwatch of claim 1 wherein said bezel has a top portion and said sound output channel exits below said top portion and above said dial.

3. The wristwatch of claim 1 wherein said speaker and said movement are arranged adjacent to each other within said case and said dial extends over said speaker and said analog movement.

4. The wristwatch of claim 1 further comprising a sound chamber disposed within said case and arranged to amplify sounds from said speaker, said sound output channel extending from said sound chamber.

5. The wristwatch of claim 1 wherein said speaker has an impedance in excess of 8 ohms.

6. The wristwatch of claim 1 wherein said speaker has an impedance of about 64 ohms.

7. The watch of claim 1, wherein said speaker control circuit comprises a memory holding signals corresponding to said sounds.

8. The watch of claim 1, further comprising a switch for controlling said speaker control circuit.

9. The watch of claim 8, further comprising a button mounted on said case for selective activation of said switch.

10. The watch of claim 1 wherein said speaker control circuit includes a digital memory, said digital memory holding digital signals corresponding said sounds.

11. The watch of claim 10, wherein said digital memory is a replaceable ROM.

* * * * *